US006617088B2

(12) United States Patent
Iizuka et al.

(10) Patent No.: US 6,617,088 B2
(45) Date of Patent: Sep. 9, 2003

(54) DEVELOPER AND IMAGE FORMING METHOD

(75) Inventors: Akihiro Iizuka, Minamiashigara (JP); Susumu Yoshino, Minamiashigara (JP); Koutarou Yoshihara, Minamiashigara (JP); Tetsuya Taguchi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/859,498

(22) Filed: May 18, 2001

(65) Prior Publication Data

US 2002/0022190 A1 Feb. 21, 2002

(30) Foreign Application Priority Data

May 22, 2000 (JP) ..... 2000-150098

(51) Int. Cl.[7] ..... G03G 9/08; G03G 9/113

(52) U.S. Cl. ..... 430/110.4; 430/111.1; 430/111.32; 430/111.35; 430/124; 430/45

(58) Field of Search ..... 430/108.1, 108.6, 430/108.7, 110.4, 111.35, 111.1, 111.32, 111.33, 124, 126, 45, 47

(56) References Cited

U.S. PATENT DOCUMENTS

| | | | | |
|---|---|---|---|---|
| 5,120,631 A | * | 6/1992 | Kanbayashi et al. | 430/110.4 |
| 5,635,325 A | * | 6/1997 | Inaba et al. | 430/108.4 |
| 5,821,022 A | * | 10/1998 | Ohishi et al. | 430/111.35 |
| 5,849,452 A | * | 12/1998 | Takenaka et al. | 430/122 |
| 6,383,704 B1 | * | 5/2002 | Kataoka et al. | 430/108.6 |

FOREIGN PATENT DOCUMENTS

| | | | |
|---|---|---|---|
| JP | 52-3304 | | 1/1977 |
| JP | A 1-133065 | | 5/1989 |
| JP | A 2-100059 | | 4/1990 |
| JP | B2 2-21591 | | 5/1990 |
| JP | A 2-161466 | | 6/1990 |
| JP | A 3-122660 | | 5/1991 |
| JP | A 3-229265 | | 10/1991 |
| JP | A 3-260659 | | 11/1991 |
| JP | 04-090558 | * | 3/1992 |
| JP | A 4-337738 | | 11/1992 |
| JP | A 4-337742 | | 11/1992 |
| JP | B2 5-40309 | | 6/1993 |
| JP | B2 6-29992 | | 4/1994 |
| JP | A 6-161145 | | 6/1994 |
| JP | A 7-84398 | | 3/1995 |
| JP | B2 7-31422 | | 4/1995 |

OTHER PUBLICATIONS

US Patent & Trademark Office English–Language Translation of JP 04–090558 (pub Mar. 1992).*

* cited by examiner

*Primary Examiner*—Janis L. Dote
(74) *Attorney, Agent, or Firm*—Oliff & Berridge, PLC

(57) ABSTRACT

A developer for a trickle developing method is used in formation of a full color image and is made of a mixture of a toner and a carrier. The toner contains inorganic fine particles as an internal additive and an external additive, a volume average particle diameter $D_{50v}$ of the toner is between 5.0 and 9.0 $\mu$m, a true specific gravity of the carrier is between 3.00 and 4.60, a volume average particle diameter of the carrier is between 15 and 60 $\mu$m, and the ratio of the volume average particle diameter of the carrier to the volume average particle diameter of the toner is between 3.00 and 7.00, and an image forming method using the developer. The developer for the trickle developing method prevents the embedding of the external additive in the toner by suppressing impact energy given by stirring the carrier and the toner in a developing device and a replenishment device of the developer, and has a resistance to toner degradation, an excellent transferability, a resistance to carrier contamination and a stable chargeability.

13 Claims, No Drawings

DEVELOPER AND IMAGE FORMING METHOD

BACKGROUND OF THE INVENTION

1. Field of the Invention

The present invention relates to a developer used in a trickle developing method in which an electrostatic latent image formed by an electrophotographic method or an electrostatic recording method is developed with a two-component developer while replenishment the developer to a developing device intermittently or continuously and discharging a part of the developer from the developing device intermittently or continuously, and an image forming method using the developer.

2. Description of the Related Art

A method in which an image information is visualized through an electrostatic latent image, such as an electrophotographic method, has been currently utilized in various fields. In the electrophotographic method, an image information is visualized such that an electrostatic latent image is formed on a photoreceptor by charging and exposure, developed with a toner-containing developer, transferred and fixed. The developer used here includes a two-component developer made of a toner and a carrier and a one-component developer made only of a toner such as a magnetic toner. The two-component developer is advantageous in that a controlling property is good because the carrier has functions of stirring, transporting and charging the developer and is functionally separated in the developer. Thus, it has been widely used at present. Especially, a developer using a carrier coated with a resin is excellent in a charge controlling property, and improves an environmental dependence relatively easily.

A method of fixing a toner image includes a heat-fixing method using a heating roller or a hot film. The method using the heating roller has been widely used because a thermal efficiency is good and high-speed fixing is enabled.

This fixing method is problematic in that a so-called offset phenomenon sometimes occurs. The offset phenomenon is that since a molten toner image is contacted with the surface of the heating roller under pressure, a part of the toner image is adhered to the heating roller, and the toner adhered is retransferred to stain a copied image.

In order to prevent the offset phenomenon, a method is employed in which a silicon rubber or a fluororesin having an excellent releasing property to a toner is coated on a surface of a heating roller and a releasing liquid such as silicon oil is further supplied to the surface thereof. This method is quite effective for preventing the offset phenomenon of the toner, but a device of feeding the offset preventing liquid is required. This is contrary to downsizing or weight reduction of a copier. Further, when the offset preventing liquid is heated and evaporated, an unpleasant smell is given or contamination inside the device occurs.

In order to solve these problems, a method in which a viscosity of a toner is limited (Japanese Patent Laid-Open Nos. 133,065/1989, 161,466/1990, 100,059/1990 and 229, 265/1991), a method in which a wax such as a releasing resin is incorporated in a toner (Japanese Patent Publication No. 3,304/1977), a method in which a melt viscosity of a wax is limited (Japanese Patent Laid-Open Nos. 260,659/1991 and 122,660/1991), a method in which a diameter of a wax domain and a ratio of a wax present on a surface of a toner are limited (Japanese Patent Laid-Open No. 84,398/1995), and a method in which a shape of a wax domain is limited (Japanese Patent Laid-Open No. 161,145/1994) have been proposed.

Further, as a developing method, a cascade method was used in the past, but at present a magnetic brush method in which a magnet roll is used as a developer transporting unit is mainly used.

In the two-component developing method which is currently widespread, a circumferential speed of a developing sleeve is generally determined to be higher than a circumferential speed of a photoreceptor for securing a satisfactory image density, namely for feeding a sufficient developer to a developing region.

However, in this method, development defects caused by a relative difference in speed between the developing sleeve and the photoreceptor, for example, trail edge deletion of a solid image and trail edge deletion of a halftone image in an interface between a lead edge of the solid image and the halftone image when the halftone image and the solid image are present occur. With respect to these image deletions, it is considered that the amount of change in a potential of a developer layer owing to the movement of the toner in a developing nip region of a developing process depends on a latent image structure and an image is developed at different speeds with a developer that has experienced a history of an electric field just before the latent image to be developed in a region where the development is actually conducted, so that these defects notably occur in discontinuous spots of the latent image structure, for example, in the interface between the solid image and the non-image portion or the interface between the halftone image and the solid image.

For inhibiting these defects, it is proposed that trail edge deletion of a solid image is improved by decreasing a resistance of a carrier (Japanese Patent Publication No. 31,422/1995). Meanwhile, when a resistance of a developer or a carrier is decreased for improving the defects, a developing effective electrode extremely approaches to a photoreceptor by the excessive decrease in the resistance to reduce an ability to feed the toner to the photoreceptor or to cause so-called brush mark in which latent image leak is generated. Accordingly, in order to prevent the excessive decrease in the resistance of the developer or the carrier, it is proposed that a lower limit of the resistance of the carrier layer is regulated (Japanese Patent Publication Nos. 40,309/1993, 29,992/1994 and 31,422/1995).

The resistance of the developer layer is generally almost determined by a resistance of a carrier and a coating rate of a toner on the carrier. Further, the resistance of the developer depends on an electric field. Therefore, in a full color image in which various latent image levels are continuously present, there is a need to control the resistance of the carrier and the coating rate of the toner on the carrier especially for avoiding the developing defects.

Nevertheless, when the development is repeated over a long period of time, the resin coating layer on the surface of the carrier in the developer is worn out and peeled off, or the toner component is adhered to the surface of the carrier to decrease a chargeability of the carrier. However, since a developing potential is fixed, the coating rate of the toner on the carrier of the developer is gradually decreased for making an image density constant. Consequently, in the full color image, the developing defects are generated before the image density is changed or fogging occurs. Thus, the problem has not yet been improved satisfactorily.

Thus, a developing method in which a carrier is added together when a toner is supplemented for a toner consumed by the development and a carrier in a developing device is replaced little by little to control a change in a charging amount and stabilize an image density (so-called a trickle developing method) is proposed in Japanese Patent Publication No. 21,591/1990.

On the other hand, to meet the requirement for a high-image quality in recent years, the size of the toner is further decreased, and a non-electrostatic adhesion between a toner and a photoreceptor is enhanced. Thus, the transfer becomes difficult. Accordingly, a method is proposed in which the shape of the toner is controlled or an external additive as a spacer is added to the outer surface of the toner to suppress a contact force between the toner and the surface of the photoreceptor (Japanese Patent Laid-Open Nos. 337,738/1992 and 337,742/1992).

However, the external additive on the surface of the toner is embedded in the toner by the long-term stirring in the developing device, and the function as the spacer is not satisfactorily exhibited. Further, in the trickle developing method in which when the toner is replenished for the toner consumed by the development, the carrier is added together and the carrier in the developing device is replaced little by little to control the change in the charging amount, the mixture of the toner and the carrier is replenished. Since the toner and the carrier are mixed by stirring in advance before being replenished, the external additive is already embedded in replenishment the same to the developing device and deterioration of the toner sometimes already proceeds. In this case, the transferring function is not satisfactorily brought forth. It is considered that the amount (coating rate) of the external additive is increased for securing the transferring function. Nevertheless, the adhesion of the external additive to the carrier is promoted by the long-term development to notably decrease the chargeability of the carrier. Thus, it is important to inhibit the deterioration of the toner by the stirring in the developing device or in the developer replenishment device.

SUMMARY OF THE INVENTION

The invention is to provide, upon solving the problems, a developer suited for a trickle developing method, which developer prevents embedding of an external additive in a toner by controlling impact energy given by stirring of a carrier and a toner in a developing device and a developer replenishment device in the long-term repetitive development and has a resistance to toner deterioration, an excellent transferability, a resistance to carrier contamination and a stable chargeability, and an image forming method using the developer.

The present inventors have assiduously conducted investigations to solve the problems in the related art, and have succeeded in solving the problems by employing the following construction.

According to an aspect of the invention, a developer for developing a full color image, which is replenished to a developing device to form a toner image and a part of which is discharged from the developing device to a discharge system is provided. The developer contains a toner and a carrier. The toner contains an external additive and inorganic fine particles as an internal additive, and has a volume average particle diameter $D_{50v}$ of 5.0 to 9.0 $\mu$m. The carrier has a volume average particle diameter of 15 to 60 $\mu$m, and the ratio of the volume average particle diameter of the carrier to the volume average particle diameter of the toner is between 3.00 and 7.00.

The carrier may have a true specific gravity of 3.00 to 4.60.

The particles of the toner may contain 6 to 25% by number of toner particles having a particle diameter of 4.0 $\mu$m or less, and may contain 1.0% by volume of toner particles having a particle diameter of 16.0 $\mu$m or more.

The inorganic fine particles as the internal additive of the toner may be subjected to treatment of imparting a hydrophobic nature.

The toner may further contain low-molecular polypropylene, low-molecular polyethylene or a wax.

The external additive of the toner may be inorganic fine particles.

The inorganic fine particles as the external additive of the toner may be subjected to treatment of imparting a hydrophobic nature.

The carrier may have a resin coating layer in which resin particles insoluble in a solvent of a resin for the resin coating layer are dispersed.

The resin particles may be made of a thermosetting resin.

The thermosetting resin may be a nitrogen-containing resin.

The carrier may alternatively have a resin coating layer which has dispersed conductive particles.

The ratio of the weights of the carrier and the toner constituting the developer may be between 2 and 10.

According to another aspect of the invention, an image forming method includes the steps of forming an electrostatic latent image on an electrostatic latent image holding member, developing the electrostatic latent image with a developer of a developing device to form a toner image, the developer containing a toner and a carrier, transferring the toner image onto a transfer medium, fixing the toner image, and during the above steps, replenishing the developer to the developing device intermittently or continuously, and discharging part of the developer from the developing device intermittently or continuously.

The toner contains an external additive and inorganic fine particles as an internal additive, and has a volume average particle diameter $D_{50v}$ of 5.0 to 9.0 $\mu$m. The carrier has a volume average particle diameter of 15 to 60 $\mu$m, and the ratio of the volume average particle diameter of the carrier to the volume average particle diameter of the toner is between 3.00 and 7.00.

The carrier may have a true specific gravity of 3.00 to 4.60.

The toner image developed may be primarily transferred onto an intermediate transfer medium in the order of the first color to at least the third color to form a full color image on the intermediate transfer medium, and the full color image is then transferred onto a final transfer medium at a time.

The fixing step may employ an oilless fixing method.

DETAILED DESCRIPTION OF THE INVENTION

In the specification, the trickle developing method is a developing method in which in the step of developing the electrostatic latent image with the developer of the developing device to form the toner image, the developer made of the mixture of the toner and the carrier is replenished to the developing device intermittently or continuously to form the toner image and a part of the developer is discharged from the developing device intermittently or continuously.

The inventors have found that when the trickle developing method is employed, the following problems arise. In the ordinary developing method, the toner and the carrier are stirred in the developing device, whereas in the trickle developing method, the toner and the carrier are stirred before the developer is replenished to the developing device. Considering the subsequent stirring in the developing device, the external additive is embedded much in the toner. Especially in the stirring before the replenishing, a considerable amount of the external additive is embedded therein.

Since the deterioration of the toner owing to the embedding of the external additive occurs by the impact when stirring the same with the carrier, it can be improved by decreasing the impact energy. That is, the stirring force is reduced or the impact energies provided by the toner and the carrier are decreased. In the two-component developing method, it is required that the toner and the carrier are stirred in the developing device to frictionally charge the toner and the carrier. When the stirring force is decreased, the charge distribution of the toner is widened. Thus, fogging occurs, and a desired charging amount is not obtained. Thus, a stable image density is hardly secured. Further, when the stirring force in the developing device is decreased, the stirring time has to be prolonged correspondingly, which prevents the increase in copying or printing speed.

Thus, it is important to decrease the impact energies provided by the toner and the carrier. Generally, energy at which an object is struck is proportional to the square of the mass and the speed of the object. Of these, the speed is determined by a stirring force when the toner and the carrier are struck. The mass is proportional to the cube of the particle diameter and the true specific gravity of the object. The smaller the particle diameter, the lower the energy in the striking by stirring. However, with the decrease in the diameter of the toner particles, the transferability is decreased, and the developability of the developer is hardly provided because of the fogging. In practice, the lower limit of the particle diameter of the toner is 5.0 $\mu$m.

Meanwhile, when the particle size of the carrier is decreased, the carrier is developed in a background. Consequently, a photoreceptor is damaged owing to adhesion of the carrier to the photoreceptor, and the carrier is developed in the toner image to cause deletion. In this connection, it has been found that by decreasing the true specific gravity of the carrier, the impact energy of the carrier can be decreased to prevent the external additive from being embedded in the toner at the time of the stirring in the developing device and the toner/carrier replenishment device.

Thus, the invention can provide the developer for the trickle developing method which developer inhibits the deterioration of the toner by controlling the impact energies of the carrier and the toner in the stirring in the developer replenishment device and the developing device to prevent the external additive from being embedded in the toner and has the excellent transferability, the resistance to carrier contamination and the stable chargeability.

That is, the invention has succeeded in securing the characteristics by providing the following properties in the developer for the trickle developing method which developer is made of the toner and the carrier.

(1) The volume average particle diameter $D_{50v}$ of the toner is between 5.0 and 9.0 $\mu$m.

(2) The true specific gravity of the carrier is between 3.00 and 4.60.

(3) The volume average particle diameter of the carrier is between 15 and 60 $\mu$m.

(4) The ratio of the volume average particle diameter of the carrier to the volume average particle diameter of the toner is between 3.00 and 7.00.

The toner has preferably a smaller particle diameter for suppressing the impact energy. However, when the volume average particle diameter is less than 5.0 $\mu$m, the fluidity of the toner is decreased to reduce the transferability, and sufficient charging is hardly provided from the carrier. Consequently, fogging occurs in a background or a density is decreased. Thus, the developability is hardly provided because of fogging. Further, when it exceeds 9.0 $\mu$m, the characteristics of the carrier cannot satisfactorily be exhibited, and a reproducibility of fine dots, a gradation and a particulate property cannot be improved. Moreover, the number of the toner particles required for developing the electrostatic latent image is decreased. Thus, the unevenness of the density is increased, and occurs easily. The pile height of the toner fixed image to paper is increased, and a solid image portion having a large amount of the toner is increased in a gloss of an image. When paper having a low gloss is used, the unevenness of the gloss is provided in which the difference in the gloss is great between the image portion and the non-image portion. The preferable volume average particle diameter of the toner is between 5.0 and 7.5 $\mu$m.

With respect to the particle size distribution of the toner, the amounts of the toner particles having the particle diameter of 4.0 $\mu$m or less are preferably between 6 and 25% by number, more preferably between 6 and 16% by number based on the total number of the toner particles. When the amounts of the toner particles having the particle diameter of 4.0 $\mu$m or less are less than 6% by number, the amounts of the particles participating in reproducibility of fine dots and particulate property are decreased, and the toner of the particle diameter which is selectively consumed because of the effective particle diameter and hardly participates in the development in the repetitive copying is retained in the developing device to gradually decrease the image quality. Meanwhile, when the amounts exceed 25% by number, the fluidity of the toner is worsened, the transportability of the developer is decreased, and an adverse effect might be given to the developability. With the very particle size distribution of the toner, the exact reproducibility of latent image fine dots can also be expected when repetitively copying an original having a large image area and a density gradient, such as a photo, a picture or a brochure.

It is advisable that the amounts of the toner particles having the particle diameter of 16.0 $\mu$m or more in the particle size distribution of the toner are 1.0% by volume or less based on the total toner particles. When the amounts exceed 1.0% by volume, there is an adverse effect on the reproducibility or the gradation of fine lines. Further, when a coarse toner powder having a particle diameter of 16.0 $\mu$m or more is present in the toner layer in the transfer, it acts to prevent an electrostatic adhesion state of a photoreceptor and a transfer medium. Thus, there is a possibility of decreasing a transfer efficiency and further decreasing an image quality.

When the true specific gravity of the carrier exceeds 4.60, the impact energy of the carrier with the toner becomes too high. Accordingly, in the trickle developing method, the external additive is embedded in the toner, and the deterioration of the toner is invited to decrease the transferability. Further, the toner adheres to the surface of the carrier to promote the deterioration of the carrier. The preferable true specific gravity of the carrier is between 3.2 and 4.6.

When the volume average particle diameter of the carrier is less than 15 $\mu$m, the carrier cannot be trapped in a magnetic field of a magnet roll of a developer holding member, and the carrier spent is much observed on a photoreceptor, which invites bad transfer. When the volume average particle diameter exceeds 60 μm, the resistance of the developer becomes too high, and the trail edge deletion of the solid image or the trail edge deletion of the halftone image in the interface of the solid image lead edge and the halftone image when the halftone image and the solid image are present is worsened. The preferable volume average particle diameter of the carrier is between 25 and 50 μm.

When the ratio of the volume average particle diameter of the carrier to the volume average particle diameter of the toner exceeds 7.00, the impact energy with the toner becomes too high, and the external additive is embedded in the toner, which invites the deterioration of the toner to decrease the transferability. Further, the toner component adheres to the surface of the carrier to accelerate the degradation of the carrier. Still further, the resistance of the developer becomes too low, and the carrier spent is notably present in the developer. When the ratio of the volume average particle diameter of the carrier to the volume average particle diameter of the toner is less than 3.00, the resistance of the developer becomes too high, and the trail edge deletion of the solid image or the trail edge deletion of the halftone image in the interface of the solid image lead edge and the halftone image when the halftone image and the solid image are present is worsened. The preferable ratio of the volume average particle diameter of the carrier to the volume average particle diameter of the toner is between 4.0 and 6.0.

In the invention, an excellent image can be formed over a long period of time using the developer in an image forming method in which a full color image having at least three colors is formed, without the need of oil coating in fixing, by a trickle developing method in which a two-component developer made of a toner and a carrier is stored in a developing device, a part of the two-component developer is discharged from the developing device intermittently or continuously and a developer made of a mixture of a toner and a carrier is replenished to the developing device.

The invention provides a great effect especially in the image forming method in which the toner image developed is primarily transferred onto an intermediate transfer medium in the order of the first color to at least the third color to form a full color image on the intermediate transfer medium, and the full color image is then transferred onto a final transfer medium at a time. This is ascribable to the severe transfer performances that the number of transfers is large in comparison with a transferring method not using the intermediate transfer medium and when the second color and those following in the full color image are transferred onto the intermediate transfer medium, the toner already transferred onto the intermediate transfer medium is returned to the photoreceptor to invite the bad transfer.

With respect to the carrier of the invention, the core of the carrier is not particularly limited so long as the foregoing conditions are satisfied. Examples thereof can include magnetic metals such as iron, steel, nickel and cobalt, alloys of these metals with manganese, chrome and rare earth elements, and magnetic oxides such as ferrite and magnetite. In view of using a magnetic brush method as a developing method, a magnetic carrier is preferable. Further, magnetic powder-dispersed particles in which a magnetic powder is dispersed in a resin are also available. As the carrier core used in the invention, ferrite particles having a composition containing 98% or more of Mn—Mg—(Sr) are preferable because a surface uniformity is easily provided and a chargeability is stable. The ferrite particles having the Cu—Zn composition have a true specific gravity of 4.9, and the true specific gravity of the carrier has to be reduced to 4.8 or less in consideration of a coating structure.

In the carrier of the invention, a resin is coated on the surface of the core. The coating resin is not particularly limited, and can be selected, as required, according to the purpose. Examples thereof can include resins known per se, for example, polyolefin resins such as polyethylene and polypropylene; polyvinyl resins and polyvinylidene resins such as polystyrene, an acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; a straight silicone resin having an organosiloxane bond or its modified product; fluororesins such as polytetrafluoroethylene, polyvinyl fluoride, polyvinylidene fluoride and polychlorotrifluoroethylene; silicone resins; polyesters; polyurethanes; polycarbonates; phenol resins; amino resins such as a urea-formaldehyde resin, a melamine resin, a benzoguanamine resin, an urea resin and a polyamide resin; and epoxy resins.

These may be used either singly or in combination. In the invention, among these resins, at least the fluorine resin and/or the silicone resin is preferable. The use of these resins is effective for preventing the carrier contamination (impaction) due to the toner or the external additive.

Resin particles and/or conductive particles can be dispersed in the resin coating layer.

Examples of the resin particles include thermoplastic resin particles and thermosetting resin particles. Of these, the thermosetting resin particles are preferable because a hardness can be increased relatively easily. Further, for imparting a negative chargeability to the toner, nitrogen-containing resin particles are preferable. These particles may be used either singly or in combination.

The average particle diameter of the resin particles is preferably between 0.1 and 2 μm, more preferably between 0.2 and 1 μm. When the average particle diameter is less than 0.1 μm, a dispersibility of the resin particles in the resin coating layer is quite bad. When it exceeds 2 μm, the resin particles tend to drop from the resin coating layer, and the inherent effect of the invention is sometimes not provided.

Examples of the conductive particles can include particles of metals such as gold, silver and copper, carbon black particles, particles of semiconducting oxides such as titanium oxide and zinc oxide, and particles obtained by coating a surface of a powder of titanium oxide, zinc oxide, barium sulfate, aluminum borate or potassium titanate with tin oxide, carbon black or metal.

They may be used either singly or in combination. Of these, carbon black particles are preferable in view of a production stability, costs and a conductivity. The type of carbon black is not particularly limited. Carbon black having a DBP oil absorption of 50 to 250 ml/100 g is especially excellent in view of the production stability.

A method of making a resin coating layer is not particularly limited. For example, a method using a solution for forming a resin coating layer in which the resin particles such as the crosslinkable resin particles and/or the conductive particles and a styrene resin, an acrylic resin, a fluororesin or a silicone resin as a matrix resin are incorporated in a solvent is mentioned. Preferable examples thereof include a dipping method in which a carrier core is dipped in the solution for forming the resin coating layer, a spray method in which the solution for forming the resin coating layer is sprayed onto the surface of the carrier core, and a kneader coater method in which the carrier core floating by flowing air is mixed with the solution for forming the resin coating layer and the solvent is removed. Of these, the kneader coater method is especially preferable.

A device for forming the resin coating layer is not particularly limited so long as it has a stirring blade for providing stirring energy. Examples thereof include a planetary mixer, a kneader coater, a HENSCHEL mixer, a continuous mixer, an extruder, a Kryptron, a Fitz mill and a Loedige mixer.

When the device for forming the resin coating layer has the stirring blade, it is also possible that after removal of the solvent, the stirring is continued to provide stirring energy.

The solvent used in the solution for forming the resin coating layer is not particularly limited so long as it can dissolve only the resin as the matrix resin, and it can be selected from solvents known per se. Examples thereof can include aromatic hydrocarbons such as toluene and xylene, ketones such as acetone and methyl ethyl ketone, and ethers such as tetrahydrofuran and dioxane.

When the resin particles are dispersed in the resin coating layer, it is important that the resin particles and the matrix resin are uniformly mixed in the thickness direction and the tangential direction of the carrier surface. This mixed state makes it possible that even when the carrier is used for a long period of time and the resin coating layer is worn out, it keeps the surface structure given before used and a good chargeability to the toner is maintained stably over a long period of time. Further, when the conductive particles are dispersed in the resin coating layer, the conductive particles and the matrix resin are uniformly mixed in the thickness direction and the tangential direction of the carrier surface, with the result that even when the carrier is used for a long period of time and the resin coating layer is worn out, it can always keep the surface structure given before used, and the degradation of the carrier can be prevented for a long period of time. Incidentally, even when the resin particles and the conductive particles are dispersed in the resin coating layer at the same time, the same effects can be brought forth at the same time.

The toner particles of the invention contain a binder resin and a colorant as main components.

Examples of the binder resin include homopolymers or copolymers of monoolefins such as ethylene, propylene, butylene and isoprene, vinyl esters such as vinyl acetate, vinyl propionate, vinyl benzoate and vinyl butyrate, α-methylene aliphatic monocarboxylic acid esters such as methyl acrylate, phenyl acrylate, octyl acrylate, methyl methacrylate, ethyl methacrylate, butyl methacrylate and dodecyl methacrylate, vinyl ethers such as vinylmethyl ether, vinylethyl ether and vinylbutyl ether, vinyl ketones such as vinyl methyl ketone, vinyl hexyl ketone and vinyl isopropenyl ketone. Typical binder resins among these are, for example, polystyrene, a styrene-alkyl acrylate copolymer, a styrene-butadiene copolymer, a styrene-maleic anhydride copolymer and polypropylene. Further, a polyester, a polyurethane, an epoxy resin, a silicone resin, a polyamide and a modified rosin are available.

The colorant is not particularly limited either. Examples thereof can include carbon black, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. Pigment·Red 48:1, C. I. Pigment·Red 122, C. I. Pigment·Red 57:1, C. I. Pigment·Yellow 97, C. I. Pigment·Yellow 180, C. I. Pigment·Yellow 12, C. I. Pigment·Blue 15:1 and C. 1. Pigment·Blue 15:3.

The toner of the invention can contain a charge control agent as required. When a charge control agent is added to a color toner, a colorless or light-colored charge control agent that does not influence the color tone is preferable. As the charge control agent, known agents can be used. An azo-type metal complex and a metal complex or a metal salt of salicylic acid or an alkyl salicylate are preferable.

The toner of the invention can contain other known components, for example, an offset preventing agent such as low-molecular polypropylene, low-molecular polyethylene or a wax. Examples of the wax can include a paraffin wax and derivatives thereof, a montan wax and derivatives thereof, a microcrystalline wax and derivatives thereof, a Fischer-Tropsch wax and derivatives thereof, and a polyolefin wax and derivatives thereof. The derivatives include oxides, polymers with a vinyl monomer and graft-modified products. Further, an alcohol, a fatty acid, a vegetable wax, an animal wax, a mineral wax, an ester wax and an acid amide are also available.

The toner of the invention can contain inorganic fine particles as an internal additive to expedite oilless fixing. For obtaining transmission of OHP, inorganic fine particles having a lower refractive index than the toner binder resin are preferable. When the refractive index is too high, the color becomes cloudy at times even in a common image. Specific examples of the inorganic fine particles can include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$ and $MgSO_4$. Of these, silica fine particles and titania fine particles are especially preferable. Silica fine particles may contain anhydrous silica, aluminum silicate, sodium silicate and potassium silicate. It is advisable that the composition is adjusted such that the refractive index is 1.5 or less.

The surfaces of the inorganic fine particles may be subjected in advance to treatment of imparting a hydrophobic nature. This treatment improves the dispersibility of the toner in the inorganic fine particles, and is effective with respect to the environmental dependence of the charging and the resistance to carrier contamination even when a part of the inorganic fine particles in the toner are exposed to the surface of the toner.

The treatment of imparting the hydrophobic nature can be conducted by dipping the inorganic fine particles in a hydrophobic agent. The hydrophobic agent is not particularly limited. Examples thereof can include a silane coupling agent, silicone oil, a titanate coupling agent and an aluminum coupling agent. These may be used either singly or in combination. Of these, the silane coupling agent is preferable.

As the silane coupling agent, for example, any of chlorosilane, alkoxysilane, silazane and a special silylating agent is available. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,N-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycydoxypropylmethyldiethoxysilane, γ-mercaptopropyltrimethoxysilane and γ-chloropropyltrimethoxysilane.

The amount of the hydrophobic agent varies with the type of the inorganic fine particles, and cannot absolutely be defined. It is usually between 5 and 50 parts by weight per 100 parts by weight of the inorganic fine particles.

Inorganic fine particles have to be added to the toner of the invention as the external additive for improving the transferability, the fluidity, the cleaning property and the charge controlling property, above all, the transferability. Examples of the inorganic fine particles can include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$ and $MgSO_4$. Of these, silica fine particles and titania fine particles are especially preferable.

It is advisable that the surfaces of the inorganic fine particles as the external additive are subjected in advance to treatment of imparting a hydrophobic nature. This treatment improves a powder fluidity of the toner and is effective with respect to the environmental dependence of the charging and the resistance to carrier contamination. The treatment of imparting the hydrophobic nature can be conducted by dipping the inorganic fine particles in the hydrophobic agent. The hydrophobic agent is not particularly limited. Examples thereof include a silane coupling agent, silicone oil, a titanate coupling agent and an aluminum coupling agent. These may be used either singly or in combination. Of these, the silane coupling agent is preferable.

As the silane-type coupling agent, for example, any of chlorosilane, alkoxysilane, silazane and a special silylating agent is available. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,N-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycydoxypropylmethyldiethoxysilane, γ-mercaptopropyltrimethoxysilane and γ-chloropropyltrimethoxysilane.

The amount of the hydrophobic agent varies with the type of the inorganic fine particles, and cannot absolutely be defined. It is usually between 5 and 50 parts by weight per 100 parts by weight of the inorganic fine particles.

For preventing the adhesion of the toner, the surface of the fixing roller has to be formed of a material having an excellent releasability to the toner, a silicon rubber or a fluororesin. A releasing liquid is effective for a fixing latitude, but moved to a transfer medium for fixing. Thus, there is a sticky feeling. Moreover, since a tape cannot be adhered, letters cannot be written with marking ink. This is remarkably observed in OHP. Further, the releasing liquid cannot make smooth the rough fixing surface, and this also causes the decrease in the transparence of OHP. According to the construction of the toner in the invention, a satisfactory fixing latitude is shown, and it is unnecessary to coat the releasing liquid such as silicone oil on the fixing roller.

EXAMPLES

The invention is illustrated more specifically by referring to the following Examples and Comparative Examples. However, the invention is not limited thereto. In the following description, "parts" are all on the weight basis unless otherwise instructed.

| [Production of toner particles a] | |
|---|---|
| Polyester resin | 77 parts |
| Vegetable wax (carnauba wax) | 6 parts |
| Aromatic hydrocarbon copolymer petroleum resin | 7 parts |
| Silica particles (R972, made by Nippon Aerosyl) | 5 parts |
| C.I. Pigment-Blue 15:3 | 5 parts |

These components are premixed well with a Henschel mixer, melt-kneaded with a biaxial roll mill, cooled, then finely divided with a jet mill, and classified twice with an air classifier to obtain toner particles in which the amounts of toner particles having a volume average particle diameter of 6.5 μm and a particle diameter of 4 μm or less are 15% by number and the amounts of toner particles having a particle diameter of 16 μm or more are 0.7% by volume.

One hundred parts of the toner particles, 0.5 part of hydrophobic titanium oxide fine particles having a BET specific surface area of 100 $m^2/g$ as an external additive and hydrophobic silica fine particles having an average particle diameter of 40 nm are mixed with a Henschel mixer to produce toner particles a (cyan toner).

[Production of Toner Particles b]

Components with the same mixing composition as that of toner a are premixed well with a HENSCHEL mixer, melt-kneaded with a biaxial roll mill, cooled, then finely divided with a jet mill, and classified twice with an air classifier to obtain toner particles in which the amounts of toner particles having a volume average particle diameter of 7.5 μm and a particle diameter of 4 μm or less are 10% by number and the amounts of toner particles having a particle diameter of 16 μm or more are 1.0% by volume.

One hundred parts of the toner particles, 0.5 part of hydrophobic titanium oxide fine particles having a BET specific surface area of 100 $m^2/g$ as an external additive and hydrophobic silica fine particles having an average particle diameter of 40 nm are mixed with a HENSCHEL mixer to produce toner particles b (cyan toner).

| [Production of carrier A] | |
|---|---|
| Mn—Mg—Sr ferrite particles (volume average particle diameter = 35 μm, core electric resistance = $10^8$ Ωcm, true specific gravity = 4.5) | 100 parts |
| Toluene | 10 parts |
| Polymethyl methacrylate resin (PMMA) | 2 parts |

The PMMA resin is diluted with toluene, and charged into a vacuum deaeration-type kneader along with the Mn—Mg—Sr ferrite particles. These are stirred at 120° C. for 30 minutes, toluene is then removed under reduced pressure, and a coating is formed on the surfaces of the ferrite particles to obtain carrier A. The volume average particle diameter of the resulting carrier A is 36.6 μm, and the true specific gravity thereof is 4.21.

| [Production of carrier B] | |
|---|---|
| Mn—Mg—Sr ferrite particles (volume average particle diameter = 35 μm, core electric resistance = $10^8$ Ωcm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 2 parts |

The perfluorooctylethyl acrylate/methyl methacrylate copolymer is diluted with toluene, and charged into a vacuum deaeration-type kneader along with the Mn—Mg—Sr ferrite particles. These are stirred at 120° C. for 30 minutes, toluene is then removed under reduced pressure, and a coating is formed on the surfaces of the ferrite particles to obtain carrier B. The volume average particle diameter of the resulting carrier B is 36.7 μm, and the true specific gravity thereof is 4.29.

| [Production of carrier C] | |
|---|---|
| Mn—Mg—Sr ferrite particles (volume average particle diameter = 35 μm, core electric resistance = $10^8$ Ωcm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 0.3 part |
| Carbon black (VXC-72 made by Cabot, oil absorption = 174 ml/100 g) | 0.06 part |
| Crosslinked melamine resin (average particle diameter = 0.3 μm) | 0.04 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Mn—Mg—Sr ferrite particles are charged into a vacuum deaeration-type kneader, and stirred at 120° C. for 30 minutes. Toluene is then removed under reduced pressure, and the coating is formed on the surfaces of the ferrite particles to obtain carrier C. The volume average particle diameter of the resulting carrier C is 35.3 μm, and the true specific gravity thereof is 4.46.

| [Production of carrier D] | |
|---|---|
| Mn—Mg—Sr ferrite particles (volume average particle diameter = 35 μm, core electric resistance = $10^8$ Ωcm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Mn—Mg—Sr ferrite particles are charged into a vacuum deaeration-type kneader, and stirred at 120° C. for 30 minutes. Toluene is then removed under reduced pressure, and the coating is formed on the surfaces of the ferrite particles to obtain carrier D. The volume average particle diameter of the resulting carrier D is 36.5 μm, and the true specific gravity thereof is 4.29.

| [Production of carrier E] | |
|---|---|
| Mn—Mg—Sr ferrite particles (volume average particle diameter = 35 μm, core electric resistance = $10^8$ Ωcm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 3.0 parts |
| Carbon black (VXC-72 made by Cabot) | 0.6 part |
| Crosslinked melamine resin (average particle diameter = 0.3 μm) | 0.4 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Mn—Mg—Sr ferrite particles are charged into a vacuum deaeration-type kneader, and stirred at 120° C. for 30 minutes. Toluene is then removed under reduced pressure, and the coating is formed on the surfaces of the ferrite particles to obtain carrier E. The volume average particle diameter of the resulting carrier E is 38.3 μm, and the true specific gravity thereof is 4.11.

| [Production of carrier F] | |
|---|---|
| Mn—Mg—Sr ferrite particles (volume average particle diameter = 50 μm, core electric resistance = $10^8$ Ωcm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 parts |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to form a solution for forming a coating. This solution for forming the coating and the Mn—Mg—Sr ferrite particles are charged into a vacuum deaeration-type kneader, and stirred at 120° C. for 30 minutes. Toluene is then removed under reduced pressure, and the coating is formed on the surfaces of the ferrite particles to obtain carrier F. The volume average particle diameter of the resulting carrier F is 51.6 μm, and the true specific gravity thereof is 4.29.

| [Production of carrier G] | |
|---|---|
| Mn—Mg—Sr ferrite particles (volume average particle diameter = 85 μm, core electric resistance = $10^8$ Ωm, true specific gravity = 4.5) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Mn—Mg—Sr ferrite particles are charged into a vacuum deaeration-type kneader, and stirred at 120° C. for 30 minutes. Toluene is then removed under reduced pressure, and the coating is formed on the surfaces of the ferrite particles to obtain carrier G. The volume average particle diameter of the resulting carrier G is 86.6 μm, and the true specific gravity thereof is 4.29.

| [Production of carrier H] | |
|---|---|
| Cu—Zn ferrite particles (volume average particle diameter = 35 μm, core electric resistance =$10^8$ Ωcm, true specific gravity = 4.9) | 100 parts |
| Toluene | 10 parts |
| Perfluorooctylethyl acrylate/methyl methacrylate copolymer (copolymerization ratio = 40:60, Mw = 50,000) | 0.3 part |
| Carbon black (VXC-72 made by Cabot) | 0.06 part |
| Crosslinked melamine resin (average particle diameter = 0.3 μm) | 0.04 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Cu—Zn ferrite particles are charged into a vacuum deaeration-type kneader, and stirred at 120° C. for 30 minutes. Toluene is then removed under reduced pressure, and the coating is formed on the surfaces of the ferrite particles to obtain carrier H. The volume average particle diameter of the resulting carrier H is 35.2 μm, and the true specific gravity thereof is 4.85.

| [Production of carrier I] | |
|---|---|
| Cu—Zn ferrite particles (volume average particle diameter = 35 μm, core electric resistance $10^8$ Ωcm, true specific gravity = 4.9) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the Cu—Zn ferrite particles are charged into a vacuum deaeration-type kneader, and stirred at 120° C. for 30 minutes. Toluene is then removed under reduced pressure, and the coating is formed on the surfaces of the ferrite particles to obtain carrier I. The volume average particle diameter of the resulting carrier I is 36.6 μm, and the true specific gravity thereof is 4.65.

| [Production of carrier J] | |
|---|---|
| Cu-Zn ferrite particles (volume average particle diameter = 50 μm, core electric resistance = $10^8$ Ωcm, true specific gravity = 4.9) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to form a solution for forming a coating. This solution for forming the coating and the Cu—Zn ferrite particles are charged into a vacuum deaeration-type kneader, and stirred at 120° C. for 30 minutes. Toluene is then removed under reduced pressure, and the coating is formed on the surfaces of the ferrite particles to obtain carrier J. The volume average particle diameter of the resulting carrier J is 51.4 μm, and the true specific gravity thereof is 4.65.

| [Production of carrier K] | |
|---|---|
| Cu-Zn ferrite particles (volume average particle diameter = 85 μm, core electric resistance = $10^8$ Ωcm, true specific gravity = 4.9) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine particles are diluted with toluene, and dispersed with a sand mill to give a solution for forming a coating. This solution for forming the coating and the Cu—Zn ferrite particles are charged into a vacuum deaeration-type kneader, and stirred at 120° C. for 30 minutes. Toluene is then removed under reduced pressure, and the coating is formed on the surfaces of the ferrite particles to obtain carrier K. The volume average particle diameter of the resulting carrier K is 86.4 μm, and the true specific gravity thereof is 4.65.

| [Production of carrier L] | |
|---|---|
| Iron powder spherical particles (volume average particle diameter = 35 μm, core electric resistance = $10^8$ Ωcm, true specific gravity = 8.0) | 100 parts |
| Toluene | 10 parts |
| Perfluorooctylethyl acrylate/methyl methacrylate copolymer (copolymerization ratio = 40:60, Mw = 50,000) | 1.5 parts |
| Carbon black (VXC-72 made by Cabot) | 0.3 part |
| Crosslinked melamine resin (average particle diameter = 0.3 μm) | 0.2 part |

The perfluorooctylethyl acrylate/methyl methacrylate copolymer, carbon black particles and crosslinked melamine resin particles are diluted with toluene, and dispersed with a sand mill to give a solution for forming a coating. This solution for forming the coating and the iron powder spherical particles are charged into a vacuum deaeration-type kneader, and stirred at 120° C. for 30 minutes. Toluene is then removed under reduced pressure, and the coating is formed on the surfaces of the iron powder spherical particles to obtain carrier L. The volume average particle diameter of the resulting carrier L is 36.9 μm, and the true specific gravity thereof is 7.27.

Ninety parts of each of carriers A to L and 10 parts of toner a are mixed to obtain each of developers Aa to Ea in Examples 1 to 5 and developers Fa to La in Comparative Examples 1 to 7. Likewise, 90 parts of each of carriers A to L and 10 parts of toner b are mixed to obtain each of developers Ab to Fb in Examples 6 to 11 and developers Gb to Lb in Comparative Examples 8 to 13. These developers are charged in a developing device at the initial stage.

Further, a supplementing developer made of a mixture of a toner and a carrier is one obtained by mixing the same components as in the above-formed developer at a (toner weight)/(carrier weight) ratio of 3.

The true specific gravity of the carrier is calculated using the following formula.

True specific gravity of a carrier=

(weight of a carrier)÷[(weight of a core)/(true specific gravity of a core)+(weight of a coating agent)/(true specific gravity of a coating agent)]

The true specific gravity of the carrier and the ratio of (volume average particle diameter of the carrier)/(volume average particle diameter of the toner) in these developers are shown in Table 1.

TABLE 1

| | | Carrier (A to L) | | | | | Toner (a, b) | Carrier/toner |
|---|---|---|---|---|---|---|---|---|
| | Developer | Core | Coating material | Coating amount (wt. %) | Particle diameter (μm) | True specific gravity | particle diameter (μm) | particle diameter ratio |
| Ex. 1 | Aa | Mn-Mg-Sr-Ferrite | PMMA | 2 | 36.6 | 4.21 | 6.5 | 5.64 |
| Ex. 2 | Ba | Mn-Mg-Sr-Ferrite | F-MMA | 2 | 36.7 | 4.29 | 6.5 | 5.65 |
| Ex. 3 | Ca | Mn-Mg-Sr-Ferrite | F-MMA/CB/MB | 0.4 | 35.3 | 4.46 | 6.5 | 5.44 |
| Ex. 4 | Da | Mn-Mg-Sr-Ferrite | F-MMA/CB/MB | 2 | 36.5 | 4.29 | 6.5 | 5.62 |
| Ex. 5 | Ea | Mn-Mg-Sr-Ferrite | F-MMA/CB/MB | 4 | 38.3 | 4.11 | 6.5 | 5.89 |
| CEx. 1 | Fa | Mn-Mg-Sr-Ferrite | F-MMA/CB/MB | 2 | 51.6 | 4.29 | 6.5 | 7.94 |
| CEx. 2 | Ga | Mn-Mg-Sr-Ferrite | F-MMA/CB/MB | 2 | 86.6 | 4.29 | 6.5 | 13.33 |
| CEx. 3 | Ha | Cu-Zn-Ferrite | F-MMA/CB/MB | 0.4 | 35.2 | 4.85 | 6.5 | 5.42 |
| CEx. 4 | Ia | Cu-Zn-Ferrite | F-MMA/CB/MB | 2 | 36.6 | 4.65 | 6.5 | 5.64 |
| CEx. 5 | Ja | Cu-Zn-Ferrite | F-MMA/CB/MB | 2 | 51.4 | 4.65 | 6.5 | 7.91 |
| CEx. 6 | Ka | Cu-Zn-Ferrite | F-MMA/CB/MB | 2 | 86.4 | 4.65 | 6.5 | 13.29 |
| CEx. 7 | La | Iron powder | F-MMA/CB/MB | 2 | 36.9 | 7.27 | 6.5 | 5.68 |
| Ex. 6 | Ab | Mn-Mg-Sr-Ferrite | PMMA | 2 | 36.6 | 4.21 | 7.5 | 4.89 |
| Ex. 7 | Bb | Mn-Mg-Sr-Ferrite | F-MMA | 2 | 36.7 | 4.29 | 7.5 | 4.89 |
| Ex. 8 | Cb | Mn-Mg-Sr-Ferrite | F-MMA/CB/MB | 0.4 | 35.3 | 4.46 | 7.5 | 4.71 |
| Ex. 9 | Db | Mn-Mg-Sr-Ferrite | F-MMA/CB/MB | 2 | 36.5 | 4.29 | 7.5 | 4.87 |
| Ex 10 | Eb | Mn-Mg-Sr-Ferrite | F-MMA/CB/MB | 4 | 38.3 | 4.11 | 7.5 | 5.10 |
| Ex 11 | Fb | Mn-Mg-Sr-Ferrite | F-MMA/CB/MB | 2 | 51.6 | 4.29 | 7.5 | 6.89 |
| CEx. 8 | Gb | Mn-Mg-Sr-Ferrite | F-MMA/CB/MB | 2 | 86.6 | 4.29 | 7.5 | 11.55 |
| CEx. 9 | Hb | Cu-Zn-Ferrite | F-MMA/CB/MB | 0.4 | 35.2 | 4.85 | 7.5 | 4.69 |
| CEx. 10 | Ib | Cu-Zn-Ferrite | F-MMA/CB/MB | 2 | 36.6 | 4.65 | 7.5 | 4.89 |
| CEx. 11 | Jb | Cu-Zn-Ferrite | F-MMA/CB/MB | 2 | 51.4 | 4.65 | 7.5 | 6.85 |
| CEx. 12 | Kb | Cu-Zn-Ferrite | F-MMA/CB/MB | 2 | 86.4 | 4.65 | 7.5 | 11.52 |
| CEx. 13 | La | Iron powder | F-MMA/CB/MB | 2 | 36.9 | 7.27 | 7.5 | 4.92 |

Ex. - Example
CEx. - Comparative Example

These electrostatic latent image developers are applied to an electrophotographic printer (remodeled oilless Color Laser Wind C411 manufactured by Fuji Xerox: remodeled such that oil is not coated in fixing; a fixing roller is made of PFA), and a copying test with an image density of 3% and a copying test with an image density of 20% are conducted.

At an initial stage (1st to 20th sheets), a stage with a peak charging amount (3,000th sheet) and a stage for identifying maintenance (100,000th sheet), a transferability and image qualities such as fogging and an image density are evaluated, and the results are shown in Table 2.

TABLE 2

| | | Initial stage (1st to 20th sheets) | | Stage with peak charging amount (3,000th sheet) | | Stage for identifying maintenance (100,000th sheet) | |
|---|---|---|---|---|---|---|---|
| | Developer | Image density 3% | Image density 20% | Image density 3% | Image density 20% | Image density 3% | Image density 20% |
| Ex. 1 | Aa | ○ | ○ | ○ | ○ | ○ | ○ |
| Ex. 2 | Ba | ○ | ○ | ○ | ○ | ○ | ○ |
| Ex. 3 | Ca | ○ | ○ | ○ | ○ | ○ | ○ |
| Ex. 4 | Da | ○ | ○ | ○ | ○ | ○ | ○ |
| Ex. 5 | Ea | ○ | ○ | ○ | ○ | ○ | ○ |
| CEx. 1 | Fa | ○ | ○ | x bad transfer | ○ | ○ | ○ |
| CEx. 2 | Ga | x bad transfer | ○ | x bad transfer | x bad transfer | x bad transfer | x fogging |
| CEx. 3 | Ha | x bad transfer | ○ | x bad transfer | ○ | ○ | ○ |
| CEx. 4 | Ia | ○ | ○ | x bad transfer | ○ | ○ | ○ |
| CEx. 5 | Ja | x bad transfer | ○ | x bad transfer | ○ | ○ | ○ |
| CEx. 6 | Ka | x bad transfer | x bad transfer | x bad transfer | x bad transfer | x bad transfer | x fogging |
| CEx. 7 | La | x bad transfer | x bad transfer | x bad transfer | ○ | ○ | ○ |
| Ex. 6 | Ab | ○ | ○ | ○ | ○ | ○ | ○ |
| Ex. 7 | Bb | ○ | ○ | ○ | ○ | ○ | ○ |
| Ex. 8 | Cb | ○ | ○ | ○ | ○ | ○ | ○ |
| Ex. 9 | Db | ○ | ○ | ○ | ○ | ○ | ○ |
| Ex. 10 | Eb | ○ | ○ | ○ | ○ | ○ | ○ |
| Ex. 11 | Fb | ○ | ○ | ○ | ○ | ○ | ○ |
| CEx. 8 | Gb | x bad transfer | ○ | x bad transfer | x bad transfer | x bad transfer | ○ |
| CEx. 9 | Hb | x bad transfer | ○ | x bad transfer | ○ | ○ | ○ |
| CEx. 10 | Ib | ○ | ○ | x bad transfer | ○ | ○ | ○ |
| CEx. 11 | Jb | ○ | ○ | x bad transfer | ○ | ○ | ○ |
| CEx. 12 | Kb | x bad transfer | ○ | x bad transfer | x bad transfer | x bad transfer | x fogging |
| CEx. 13 | La | x bad transfer | ○ | x bad transfer | ○ | ○ | ○ |

Ex. - Example
CEx. - Comparative Example (Results)

As is clear from Table 2, in Comparative Examples 1 to 13 in which the true specific gravity of the carrier is large and the carrier/toner particle diameter ratio is high, the impact to the toner is great, and the fatigue of the toner (embedding of the external additive) occurs. When the extent of the fatigue is slight, the bad transfer due to the decrease in the transfer efficiency occurs. When the fatigue is great (Comparative Examples 2, 6 and 12), the contamination of the carrier with the toner component is induced by the impact, and the fogging occurs. Moreover, the image density is between 1.6 and 1.9. On the other hand, in the developers of Examples to meet the requirements of the invention, the fatigue of the toner and the contamination of the carrier are not observed, and the excellent image quality is provided over a long period of time.

According to the invention, the stable image quality can be obtained from the initial copying stage to the stage in which the maintenance is identified by employing the construction of the invention.

The entire disclosure of Japanese Patent Application No. 2000-150098 filed on May 22, 2000 including specification, claims and abstract is incorporated herein by reference in its entirety.

What is claimed is:

1. A developer for developing a full color image, which is replenished to a developing device to form a toner image and a part of which is discharged from the developing device to a discharge system, the developer comprising a toner and a carrier, wherein the toner contains an external additive and inorganic fine particles as an internal additive, and has a volume average particle diameter $D_{50v}$ of 5.0 to 9.0 $\mu$m;

the carrier has a resin coating layer in which resin particles insoluble in a solvent of a resin for the resin coating layer are dispersed, a volume average particle diameter of 15 to 60 $\mu$m, and a true specific gravity of 3.00 to 4.60; and the ratio of the volume average particle diameter of the carrier to the volume average particle diameter of the toner is between 3.00 and 7.00.

2. The developer as claimed in claim 1, wherein the carrier has a true specific gravity of 3.20 to 4.60.

3. The developer as claimed in claim 1, wherein particles of the toner contains 6 to 25% by number of toner particles having a particle diameter of 4.0 $\mu$m or less, and contains 1.0% by volume of toner particles having a particle diameter of 16.0 $\mu$m or more.

4. The developer as claimed in claim 1, wherein the inorganic fine particles as the internal additive of the toner are subjected to treatment of imparting a hydrophobic nature.

5. The developer as claimed in claim 1, wherein the external additive of the toner is inorganic fine particles.

6. The developer as claimed in claim 5, wherein the inorganic fine particles as the external additive of the toner are subjected to treatment of imparting a hydrophobic nature.

7. The developer as claimed in claim 1, wherein the resin particles are made of a thermosetting resin.

8. The developer as claimed in claim 7, wherein the thermosetting resin is a nitrogen-containing resin.

9. The developer as claimed in claim 1, wherein the ratio of the weights of the carrier and the toner constituting the developer is between 2 and 10.

10. An image forming method comprising:

forming an electrostatic latent image on an electrostatic latent image holding member;

developing the electrostatic latent image with a developer of a developing device to form a toner image, the developer comprising a toner and a carrier;

transferring the toner image onto a transfer medium;

fixing the toner image; and during the above steps, replenishing the developer to the developing device intermittently or continuously, and discharging part of the developer from the developing device intermittently or continuously, wherein the toner contains an external additive and inorganic fine particles as an internal additive, and has a volume average particle diameter $D_{50v}$ of 5.0 to 9.0 $\mu$m, the carrier has a resin coating layer in which resin particles insoluble in a solvent of a resin for the resin coating layer are dispersed, a volume average particle diameter of 15 to 60 $\mu$m, and a true specific gravity of 3.00 to 4.60, and the ratio of the volume average particle diameter of the carrier to the volume average particle diameter of the toner is between 3.00 and 7.00.

11. The image forming method as claimed in claim 10, wherein the carrier has a true specific gravity of 3.20 to 4.60.

12. The image forming method as claimed in claim 10, wherein the toner image developed is primarily transferred onto an intermediate transfer medium in an order of a first color to at least a third color to form a full color image on the intermediate transfer medium, and the full color image is then transferred onto a final transfer medium at a time.

13. The image forming method as claimed in claim 10, wherein an oilless fixing method is used in the fixing step.

* * * * *